United States Patent [19]

Schwarz

[11] 3,949,041

[45] Apr. 6, 1976

[54] METHOD FOR TEXTURING SYNTHETIC FILAMENT YARN

[76] Inventor: Eckhard C. A. Schwarz, 115 N. Park Ave., Neenah, Wis. 54956

[22] Filed: Jan. 17, 1974

[21] Appl. No.: 434,314

[52] U.S. Cl. ..... 264/168; 28/1.2; 28/1.3; 28/71.3; 264/210 F; 264/290 N; 264/290 T

[51] Int. Cl.[2] ..... D01D 5/22

[58] Field of Search ..... 28/1.3, 1.2, 71.3; 264/168, 167, 290, 210 F, 293, 177 G

[56] References Cited

UNITED STATES PATENTS

| | | | |
|---|---|---|---|
| 2,278,879 | 4/1942 | Hunter | 264/168 |
| 2,296,394 | 9/1942 | Meloon | 57/140 J |
| 2,313,630 | 3/1943 | Dockerty | 264/168 |
| 2,975,474 | 3/1961 | Smith | 264/167 |
| 3,024,516 | 3/1962 | Bromley et al. | 28/71.3 |
| 3,069,726 | 12/1962 | Adams | 264/290 |
| 3,154,807 | 11/1964 | Muller et al. | 28/71.3 |
| 3,212,158 | 10/1965 | Kasey | 28/71.3 |
| 3,242,248 | 3/1966 | Terra | 28/71.3 |
| 3,293,843 | 12/1966 | Bibby et al. | 264/168 |
| 3,379,808 | 4/1968 | McIntosh et al. | 264/293 |
| 3,388,198 | 6/1968 | Sims | 264/177 F |
| 3,417,446 | 12/1968 | Fairclough et al. | 264/168 |

FOREIGN PATENTS OR APPLICATIONS

| | | | |
|---|---|---|---|
| 45-34770 | 11/1970 | Japan | 264/168 |

*Primary Examiner*—Jay H. Woo
*Attorney, Agent, or Firm*—Henry C. Fuller

[57] ABSTRACT

In a non-friction texturing process, the filaments of a thermoplastic polymer yarn are heated along spaced zones to form latent crimps in the filaments. The filaments are then drawn and are subsequently heated above the glass transition temperature of the polymer while the filaments are under low enough tension to allow crimps to form in the filaments. The heating along spaced zones is preferably accomplished by passing the filaments over a grooved heating roller.

5 Claims, 5 Drawing Figures

METHOD FOR TEXTURING SYNTHETIC FILAMENT YARN

BACKGROUND OF THE INVENTION

This invention relates to a crimped continuous filament yarn having enhanced bulk level, and for a process of making such yarn. More particularly, the invention relates to a process at high speed giving excellent crimp uniformity and regularity.

Numerous types of yarns and processes having crimp and bulk have been proposed in the prior art, and are particularly useful when the yarn is to have substantial stretch. Typical conventional texturing machines known in the trade apply the method of false twisting by a rotating spindle as shown in U.S. Pat. Nos. 3,738,095 and 3,740,939. The disadvantages of the methods of these patents is that the process involves relatively slow speeds (maximum of 400 meters/minute), and the process is lubricant sensitive. In addition, spindles have to be cleaned periodically from yarn finish deposits to remain operational. Another known system of texturing is false twisting in a fluid jet as shown in Bense U.S. Pat. No. 3,742,692, which tends to give low bulk levels.

Another type of crimped yarn is produced by conjugate spinning, i.e. extruding two polymer components in a parallel relationship into a single filament. If the polymer components have different shrinkages, the drawn filament will develop crimp when heated. Conjugate spinning has a number of disadvantages, such as the necessity for metering the two components to the spinneret orifices, and the elaborate distribution passageways required for properly distributing both polymer components to each orifice. (Breen U.S. Pat. No. 2,931,091)

Another crimped yarn is produced by drawing a homogeneous or single component yarn over a sharp edge. In this process a helical crimp is produced, which tends to be irregular. A further prior art process is disclosed in U.S. Pat. No. 3,226,792 to Starkie, wherein nylon 66 yarn is stretched, heated on one side to a temperature below the melting point of the yarn, while being cooled on the opposite side. This yarn is later unwound, placed in hot water to develop, crimp, and rewound.

Another prior art process is disclosed in U.S. Pat. No. 3,769,669, where one side of a monofilament is heated under tension to slightly above its melting point by means of a roll, while the opposite side is kept cool by another roll to below 100°C. This process has not been demonstrated to be usable above a speed of 1,800 feet per minute (550 meters per minute).

SUMMARY OF THE INVENTION

According to the present invention, a crystallizable synthetic filament yarn is heated along spaced zones to develop latent crimp therein. The yarn is then drawn and is subsequently heated above the glass transition temperature of the polymer while the yarn is under low enough tension to allow crimps to form therein. In the preferred apparatus of this invention, the yarn is guided over a heated rotating roll having grooves transverse to the yarn direction, the yarn being undrawn or partially drawn and having an elongation of at least 120%. The yarn is fed to the grooved roll by a pair of feed rolls running at a given speed, and is then drawn over the grooved roll by a pair of draw rolls running at a speed at least 1.05 times as fast as the feed rolls.

As the yarn passes over the hot grooved roll, the grooved roll assumes the surface velocity of the entering (undrawn) yarn velocity, or the grooved roll can be driven to that velocity. The draw point of the yarn being stretched between feed rolls and draw rolls is initiated and localized by hot fluid impinging upon the yarn and the grooved roll near the point where the yarn leaves the grooved roll in the direction toward the draw rolls. The yarn produced in this manner has latent crimp, which can be developed by heating the yarn above the glass transition temperature of the polymer while being under no or little tension, either in a heating-relaxing step placed immediately after the draw roll (as shown in U.S. Pat. No. 3,769,669), or in a rewinding step at a later time, as most practically done during a beaming operation where multiple strands are wound on a single core, customarily at relatively slow speed and at low tension.

In this process, high bulk levels and regular crimping patterns can be obtained for a plurality of filaments at process speeds higher than in any other known texturing process. Another advantage of this process is that the draw or stretching step in a conventional spin-draw operation can be combined with the step of imparting latent crimp into the yarn, therefore eliminating the need for a separate texturing operation.

Accordingly, a primary object of this invention is to provide a crimped filament yarn of high bulk level.

A further object of this invention is to provide a process for making yarns of the above character which eliminates the need for a separate texturing operation.

Further objects and advantages will be apparent from the following disclosure and accompanying drawings.

DESCRIPTION OF THE PREFERRED EMBODIMENTS

Although the disclosure hereof is detaled and exact to enable those skilled in the art to practice the invention, the physical embodiments heren disclosed merely exemplify the invention which may be embodied in other specific structure. The scope of the invention is defined in the claims appended hereto.

Figure 1:
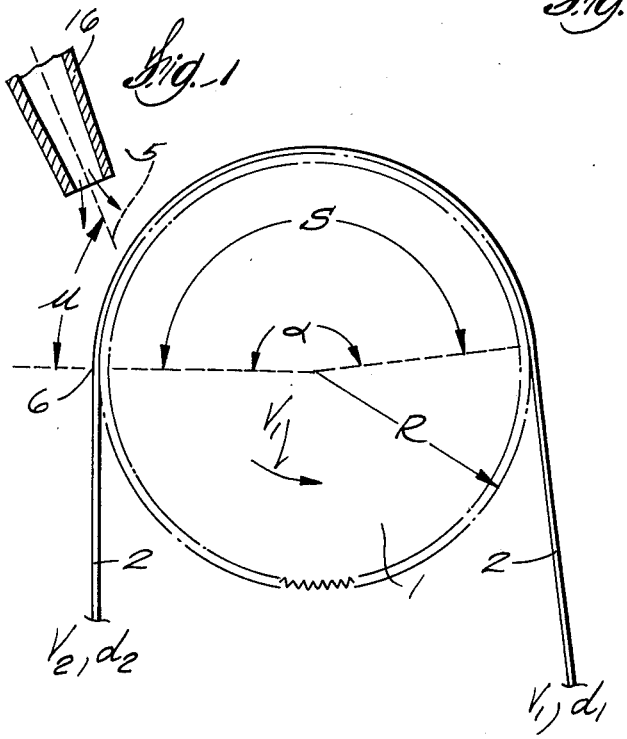
FIG. 1 is a schematic cross sectional view of yarn passing over a grooved roll showing the approximate location of hot fluid impinging on the yarn from an orifice to initiate drawing of the yarn.
Figure 4:
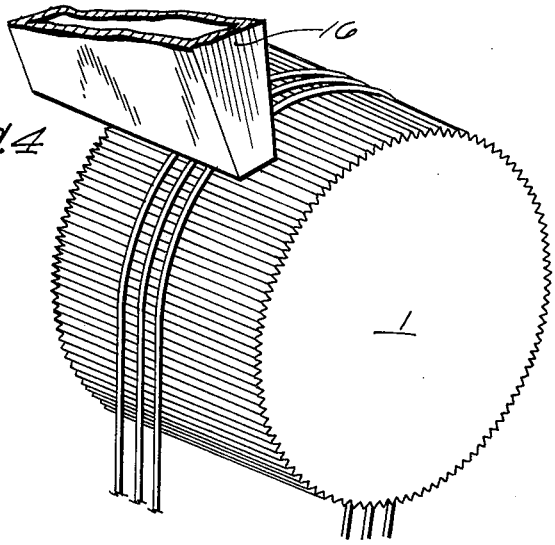
FIG. 4 is a schematic perspective view of the yarn passing over the grooved roll.
Figure 2:
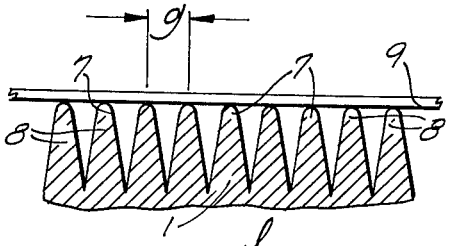
FIG. 2 shows an enlarged cross sectional view of the grooved roll surface with the yarn in position over the grooves.

Referring more specifically to FIG. 1, yarn 2 passes over the grooved roll 1 at a velocity $V_1$, the grooved roll surface velocity also being $V_1$. The yarn length "S" which is in contact with the roll is determined by the wrap angle $\alpha$ and the roll radius "R", and has to be controlled in accordance with the yarn speed $V_1$ and the single filament denier $d$ of the yarn to provide a predetermined contact time with the grooved roll surface, which is heated to near or above the polymer melt temperature. The yarn is then pulled off the grooved roll toward the draw rolls 17 and 18 (FIG. 5) at a velocity $V_2$, which exceeds that of $V_1$, for example, by a factor of 1.5.

The hot fluid impinging near the point 5 where the yarn 2 leaves the grooved roll 1 causes the yarn 2 to stretch at that point by a factor of $V_2/V_1$, accompanied by a reduction in yarn denier by approximately $V_1/V_2$.

To obtain optimum effect of texturing, it is preferable that the draw point 5 is not moved too far upward from the yarn exit point 6, indicated by the distance *u* in FIG. 1. Friction of the accelerated yarn on the grooved roll tends to accelerate the roll surface speed from $V_1$ toward $V_2$, which in turn diminishes the texturing and bulking effect. For most process conditions, *u* can be one-half or less of the distance "S", and is preferably as small as possible.

While the invention will be described in connection with the preferred embodiments, it will be understood that the invention is not limited to these embodiments. On the contrary, the invention includes all alternatives, modifications and equivalents as may be included within the spirit and scope of the invention as defined by the appended claims.

In general terms, the method of this invention involves the steps of heating spaced zones of the yarn filaments, drawing the filaments after they have been heated along the spaced zones, and subsequently heating the filaments to a temperature above the glass transition of the yarn polymer while the filaments are under low enough tension to allow crimps to form in the filaments. Referring to FIG. 1, the heated zones in the instant example correspond to the regions 7 immediately above the rounded points 8 of the grooved heating roll 1. The heated points 8 conduct heat into the spaced zones 7 thereabove but not into the open regions therebetween. The distance *g* between the centers of adjacent spaced heated zones 7 is preferably in the range of 2 to 50 times the average unstretched filament diameter. However, it should be understood that the spaced heated zones could be made by other apparatus than the grooved heated roll 1. For example, in one experiment, spaced heated zones were formed manually by holding a heated needle against one side of a yarn filament for a brief period of time and repeating the procedure at spaced locations along the filament. Accordingly, it should be understood that the method of this invention encompasses any suitable means of heating spaced zones on the filaments regardless of the particular apparatus employed to achieve this end.

In the method of this invention, the filaments are preferably heated to a temperature of at least 50°C. below the melting point of the filament. The filament is preferably maintained in contact with the source of heat for a time which is equal to X · (denier per filament) seconds, where X is a factor which preferably falls within the range of 0.00004 to 0.0008. Following the heating of the spaced zones, the filament is drawn by at least 5%. In connection with the apparatus illustrated in FIG. 1, a hot fluid of at least 70°C. impinges on the grooved roll and filaments with a velocity of at least 50 M/sec. near the point where the yarn departs from the grooved roll towards the draw rolls, which preferably pulls the yarn at a velocity at least 5% faster than the feed velocity.

Figure 3:
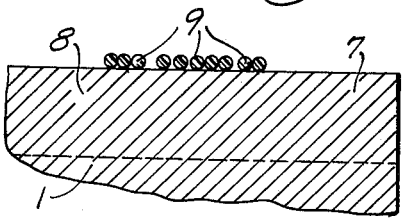
FIG. 3 is a view vertical to FIG. 2, showing the filament cross section, which makes up the yarn lying on the roll surface.

As shown in FIG. 3, the individual filaments 9 of the yarn are preferably separated and are disposed in side-by-side relationship on the surface of heating roll 1, which may be heated by an electric heating element (not shown) or by any other suitable means.

Figure 5:
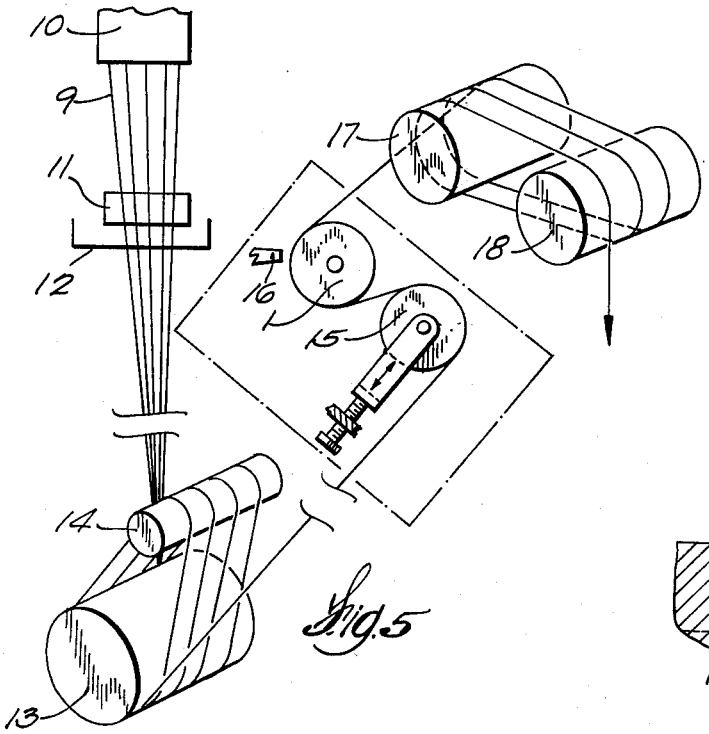
FIG. 5 is a schematic diagram showing the grooved roll device used in combination with an existing conventional spin-draw apparatus.

FIG. 5 is a schematic diagram of apparatus for placing the latent crimp in the yarn. The individual filaments 9 of the yarn are spun out of spinnerettes 10 and are passed over a finishing roll 11 which picks up finishing liquid from a pan 12. (If desired, a package of undrawn yarn could be used in place of the spinnerettes 10). The yarn then passes several times around separator rolls 13 and 14 as shown in FIG. 3. The yarn then passes over a freely rotating guide roll 15 and then to heating roll 1 as shown in FIGS. 1 – 4. The yarn subsequently is drawn at a faster velocity $V_2$ by draw rolls 17 and 18. This apparatus produces the latent crimp in the yarn which is later allowed to crimp by heating the yarn above the glass transition temperature of the yarn polymer while the yarn is under low enough tension to allow the crimp to form. It is not necessary to bring out the latent crimp before the yarn is woven into a fabric. The fabric may be woven while the yarn is still straight, with the latent crimp being brought out after weaving by heating the fabric above the glass transition temperature of the yarn polymer.

The reasons underlying the crimping action have not been fully investigated, but it is believed that the crimping action results from the following factors:

Crystal structure of oriented polymers is in part determined by the temperature at which the polymer has been oriented. Crystal structure and size in turn influence the degree of shrinkage of a crystalline oriented polymer (in this case, yarn), when heated above its glass transition temperature. The contact of the filaments of this invention with the grooved roll for a specified time introduces a periodic temperature pattern, which under optimum conditions causes periodic changes in the crystal structure on one side of the filament, which leads to differential shrinkage on opposite sides of the filaments, which in turn is the cause of the regular crimp observed on the yarns of this invention when the yarns are heated above the glass transition temperature when under no or little tension. Too long a contact time with the grooved roll will raise the temperature of the filaments too uniformly, and no or little crimp and bulk results. Similarly, too short a contact time will not result in crimp and bulk, because minor differences in polymer crystal structure will exert little difference in shrinkage forces.

EXAMPLE I

Polyethylene terephthalate having an intrinsic viscosity of 0.65 is melt spun through a 34-hole spinnerette at a throughput of 6.32 lb./hr. (2.870 Kg./hr.). The yarn bundle passes around a pair of feed and separator rolls 13 and 14 (FIG. 5) running at a circumferential speed of 700 m/min. and over the freely rotating guide roll 15 to the grooved roll 1. The freely rotating grooved roll 1 has a diameter of 2.54 cm. The grooves are 250 microns apart and approximately 350 microns deep. The roll surface is heated to a temperature of 270°C. The yarn has a wrap angle of 165° resulting in a contact length of "S" = 3.66 cm. This results, at a feed yarn speed of 700 m/min., in a contact time of 0.00314 seconds, the undrawn single filament denier being 18. Hot air of 200°C. is impinged on the yarn at about 200 m/second velocity from the orifice 16 (FIG. 5) at a distance $u = 0.3$ cm. from the point of tangential departure of the yarn toward the draw rolls running at a circumferential speed of 2840 m/min., and is then collected on a winder.

The drawn yarn has a denier of 150, a tenacity of 4.1 grams per denier, an elongation at break of 35%, and a boil-off-shrinkage of 12%. When immersing the yarn in boiling water for ten minutes, crimping and bulking occurs. For measuring the boil-off-shrinkage of the yarn, this crimp is carefully removed to measure the actual contraction of the yarn, without the additional contraction due to the crimp. The texturing crimp was measured after heating a yarn sample of this example to 160°C. for 30 seconds without applying tension. This yarn had a crimp of 50 per inch, or approximately 2/mm. The crimps were helical and of irregularly alternating direction.

EXAMPLE II

The following example shows the relationship of spun filament denier, grooved roll contact time with the yarn, and effect on texture development when the yarn is subsequently heated when under no tension. The spinning series of Table I of this example shows that optimum texturing intensity is obtained at a contact time which is approximately linearly proportional to the denier per filament.

Polyethylene terephthalate was spun as in Example I, but throughput, operating velocities, spinnerette design (number of holes) and the diameter of the grooved roll was varied to vary the filament denier and contact time of the yarn with the grooved roll. Draw ratio was kept at 4.1 as in example I, i.e. the draw rolls were running 4.1 times as fast as the feed rolls.

The texturing effect was evaluated by examining the crimp developed upon heating a 20 cm. long yarn sample at 160°C. for 30 seconds. The yarn was freely suspended and under no tension.

During this heating, shrinkage of the yarn as well as additional contraction due to the developed crimp occurred. "Texturing intensity" was rated by measuring the extended length of the heated yarn sample, and then letting the yarn contract back into its crimped state while under a tension of 0.02 gram per denier. Contraction is calculated as percent of extended length. Texturing intensity is then defined as follows (see Table I):

0 = no crimp development
1 = very slight crimp, crimped length = 95 – 99%
2 = marginal crimp, crimped length = 80 – 95%
3 = good crimp, crimped length = 65 – 80%
4 = excellent crimp, crimped length is less than 65%

Table I

Continuous Spin-Draw-Texturing of Polyethylene Terephthalate

| Run No. | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Throughput (Kg/hr) | 2.87 | 2.87 | 0.72 | 1.43 | 0.72 | 2.87 | 2.87 | 1.43 | 0.36 | 0.18 | 2.87 | 1.43 | 0.287 | 0.144 | 0.72 |
| Number of filaments | 34 | 34 | 34 | 34 | 17 | 17 | 17 | 17 | 17 | 17 | 8 | 8 | 8 | 8 | 8 |
| Feed roll speed (Meter/min.) | 700 | 700 | 175 | 350 | 87.5 | 700 | 700 | 350 | 87.5 | 44 | 700 | 350 | 70 | 35 | 17.5 |
| Denier per filament(dpf) | 18 | 18 | 18 | 18 | 18 | 36 | 36 | 36 | 36 | 36 | 77 | 77 | 77 | 77 | 77 |
| Wrap angle (grooved roll) (degree) | 82.5 | 165 | 165 | 165 | 165 | 82.5 | 165 | 165 | 165 | 165 | 165 | 165 | 165 | 165 | 165 |
| Grooved roll diameter(cm) | 1.27 | 1.27 | 5.08 | 5.08 | 5.08 | 1.27 | 1.27 | 5.08 | 5.08 | 5.08 | 1.27 | 5.08 | 5.08 | 5.08 | 5.08 |
| Contact time ("t") (seconds × $.10^3$ (grooved roll) | 0.78 | 1.6 | 25 | 13 | 50 | 0.78 | 1.6 | 13 | 50 | 100 | 1.6 | 13 | 63 | 125 | 251 |
| t/dpf (× $10^4$) | 0.43 | 0.89 | 14 | 7.2 | 28 | 0.22 | 0.45 | 3.6 | 14 | 28 | 0.21 | 1.7 | 8.2 | 16 | 33 |
| Texture intensity** | 2 | 4 | 2 | 3 | 1 | 2 | 3 | 4 | 2 | 1 | 2 | 4 | 4 | 2 | 1 |

**See Definition

EXAMPLE III

The experiment listed in Example II (Table I, Run No. 8) was repeated, but various different grooved roll temperatures were applied. Also in part of this series, an aqueous spin finish was applied prior to the yarn entering the feed wheel as shown in FIG. 5. The spin-finish was a solution of ten parts by weight of polyethylene oxide of a molecular weight of 1,000, and 90 parts by weight of water. About 6% of this finish solution was applied to the yarn from the rotating finish wheel in cases where indicated in Table II below.

The conclusion drawn from Table II is that the higher the temperature of the grooved roll, the more intense the crimp development. At some point, the yarn becomes difficult to wind onto the groove because of melting. The upper practical temperature limit was higher in the cases where finish is applied.

Table II

| Run No. | 1 | 2 | 3 | 4 | 5 | 6 | 7 | 8 | 9 | 10 |
|---|---|---|---|---|---|---|---|---|---|---|
| Grooved roll Temp.(°C.) | 200 | 250 | 280 | 290 | 150 | 200 | 250 | 280 | 295 | 310 |
| Finish applied | — | — | — | — | — | + | + | + | + | + |
| Texturing intensity | 3 | 3 | 4 | 4 | 1 | 2 | 3 | 3 | 4 | 4 |

EXAMPLE IV

In this example, the air temperature and pressure in the manifold which feeds the jet orifice is varied. Other experimental conditions remain the same as in Table I, Run No. 8. The experimental series shows that texturing development is relatively independent of air conditions as long as pressure and temperature are high enough to cause the yarn draw point to be localized at the end of the grooved roll contact.

Table III

| Run No. | 1 | 2 | 3 | 4 | 5 | 6 | 7 | 8 | 9 | 10 | 11 |
|---|---|---|---|---|---|---|---|---|---|---|---|
| Air Temp. °C. | 200 | 200 | 200 | 150 | 150 | 150 | 150 | 110 | 110 | 110 | 110 |
| Pressure (psig) | 80 | 30 | 5 | 80 | 30 | 20 | 10 | 50 | 30 | 20 | 10 |
| Texturing Intensity | 4 | 4 | —* | 4 | 4 | 4** | —* | 4 | 4 | 4** | —* |

*Erratic drawing, no yarn wound up
**Erratic drawing, poor operation

EXAMPLE V

In the following example, different grooved rolls having varying groove-to-groove distances were used to determine the effect on texturing intensity. All roll diameters were 1.27 cm.

Table IV

| Run No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Groove-to-groove distance (mm) | .250 | .500 | 1 | 2 | .25 | .5 | 1 | 2 | 4 | .25 | .5 | 1 | 2 | 4 |
| Denier per filament | 18 | 18 | 18 | 18 | 36 | 36 | 36 | 36 | 36 | 77 | 77 | 77 | 77 | 77 |
| Experimental conditions Table I, Run No. | 2 | 2 | 2 | 2 | 8 | 8 | 8 | 8 | 8 | 12 | 12 | 12 | 12 | 12 |
| Texturing intensity | 4 | 3 | 1 | 1 | 4 | 4 | 3 | 2 | 1 | 4 | 4 | 3 | 2 | 1 |

This example demonstrates that texturing intensity diminishes with groove distance, but is dependent on single denier per filament.

EXAMPLE VI

In this example the impingement point of the hot fluid (air) was moved up to move the draw point of the yarn backward. According to FIG. 1, the distance $u$ by which the impingement point is moved upward is given as a fraction of the total yarn contact distance "S", where "S" = roll diameter × 3.1416 × wrap angle (°) /360 = 5.08 × 3.1416 × 165/360 cm = 7.3 cm.

For the following experimental series, extrusion, spinning and drawing conditions were used as in Table I, Run No. 8.

Table V

| Run No. | 1 | 2 | 3 | 4 | 5 | 6 |
|---|---|---|---|---|---|---|
| u/S | 0.1 | 0.2 | 0.3 | 0.4 | 0.5 | 0.6 |
| Texturing intensity | 4 | 4 | 3 | 1 | 1 | 0 |

EXAMPLE VII

This example demonstrates the use of spun polyester yarn wound on a core as the feed yarn than a continuous spin-draw process. A partially oriented feed yarn "A" (properties in Table VI) is unwound from a core through a guide system to the feed wheel of the draw machine of FIG. 5 and then processed under conditions listed in Table VI. Feed yarn "B", a commercial textile yarn (DuPont's "Dacron" Type-56) is processed under similar conditions.

The experiments of Table VII show that Yarn "A" shows good texture development upon heating. Yarn "B" shows diminishing texture, the lower the draw ratio.

Table VI

| Yarn | "A" | "B" |
|---|---|---|
| Polymer | Polyethylene Terepthalate | Polyethylene Terepthalate |
| Tensile strength (gram per denier) | 2.1 | 4.5 |
| Yarn denier | 250 | 150 |
| Number of filaments | 34 | 34 |
| Elongation at break (%) | 140 | 35 |
| Boil-off-shrinkage | 65 | 8.5 |

Table VII

The test runs below were executed with a grooved roll of 1.27 cm. diameter, groove distance of 0.25 mm. Grooved roll and air temperature and pressure were kept as in Example I, as well as the impingement point.

| Yarn Run No. | "A" 1 | "A" 2 | "B" 3 | "B" 4 | "B" 5 | "B" 6 |
|---|---|---|---|---|---|---|
| Feed rolls (m/min.) | 700 | 1400 | 1160 | 2320 | 1160 | 2320 |
| Draw rolls (m/min.) | 1085 | 2170 | 1276 | 2552 | 1218 | 2436 |
| Draw ratio | 1.55 | 1.55 | 1.1 | 1.1 | 1.05 | 1.05 |
| Wrap angle (degree) | 165 | 165 | 165 | 165 | 165 | 165 |
| Contact time (t) (sec. × $10^3$) | 1.6 | 0.8 | 0.95 | 0.47 | 0.95 | 0.47 |
| Denier per filament (dpf) | 7.4 | 7.4 | 4.4 | 4.4 | 4.4 | 4.4 |
| t/dpf × $10^4$ | 2.2 | 1.1 | 2.2 | 1.1 | 2.2 | 1.1 |
| Texture intensity | 4 | 3 | 2 | 2 | 1 | 0 |

EXAMPLE VIII

Nylon 6—6 was processed under identical conditions of Example II, Run No. 8, a texture intensity of 4 developed upon heating to 160°C. for 30 seconds.

EXAMPLE IX

Polypropylene, melt-flow 6.0 min, (ASTM — method 1238-65T) was processed under conditions of Example II, Run No. 8, with the exception of having the temperature of the grooved roll set at 170°. A texture intensity of 3 developed when the yarn was heated to 135°C. for 30 seconds.

EXAMPLE X

An unstretched monofilament of polyethylene terephthalate having a denier of 1,225 and a diameter of 0.35 mm. was placed under a microscope and a spot on the upper side was heated with a needle having a temperature of 300° C. for a duration of about 0.5 seconds. The procedure was repeated at spots separated by 1 mm. along the filament to obtain a regularly treated filament of about 10 cm. Several yards of untreated filament was on both ends of the treated section to be able to thread the filament on a small laboratory draw machine having two sets of rolls, the feed rolls, running at 10 feet per minute, and the draw rolls, running at 38 feet per minute.

The monofilament was drawn in this device. Stretching was initiated by a stream of hot air impinging on a pin over which the filament is drawn at an angle of 175°, the pin being located between the feed and draw rolls. The impinging air had a temperature of about 150° C. and a velocity of 200 m/second. The treated section of the filament developed a curly crimp when heated to 160° C. for 30 seconds.

What is claimed is:

1. A method of forming latent crimps in synthetic thermoplastic condensation polymer filaments, such as polyethylene terephthalate or polyhexamethylene adipamide, comprising the steps of:

A. heating discrete spaced zones on one side of molecularly orientable filaments, having a tensile elongation at break of at least 30% to a temperature from about 150 to about 310° C for a time in seconds which is equal to X times denier per filament, where X is a value which falls within the range of 0.002 to 0.00002, and wherein the centers of said zones are spaced from 2 to 50 times the filament thickness, said heating of said zones being affected by guiding the filaments about a rotating grooved heated roll having circumferentially spaced lands generally parallel to the roll axes with the lands spaced 2 to 50 times the thickness of the filament;

B. Subsequently subjecting said filaments to molecular orientation by drawing them to a draw ratio of at least 1.10 by guiding the filaments at a first velocity rate over the grooved roll and drawing the filament away from the grooved roll at a faster second rate.

2. The method of claim 1 wherein the filaments are drawn near the point of tangential departure from the grooved roll by impingement of a stream of hot fluid on the filaments, the stream having a velocity of at least 50 meters per second.

3. The method of claim 2 wherein the temperature of said fluid is at least 70°C but less than a temperature that would melt the filaments.

4. The method of claim 1 including the subsequent step of developing the latent crimp by heating the filaments to a temperature sufficient to develop the crimps while the filaments are under a low enough tension to allow the crimps to develop.

5. The method of claim 1 including the intermediate step of cooling the filaments prior to developing the crimps.

* * * * *